US008353335B2

(12) United States Patent
Ploppa et al.

(10) Patent No.: US 8,353,335 B2
(45) Date of Patent: Jan. 15, 2013

(54) HEAT EXCHANGER TUBE AND METHOD OF FORMING THE SAME

(75) Inventors: Martin Ploppa, Pfullingen (DE); Daniel Borst, Wolfschlugen (DE)

(73) Assignee: Modine Manufacturing Company, Racine, WI (US)

( * ) Notice: Subject to any disclaimer, the term of this patent is extended or adjusted under 35 U.S.C. 154(b) by 668 days.

(21) Appl. No.: 12/538,365

(22) Filed: Aug. 10, 2009

(65) Prior Publication Data

US 2010/0025029 A1 Feb. 4, 2010

Related U.S. Application Data

(63) Continuation of application No. PCT/US2007/085921, filed on Nov. 29, 2007.

(30) Foreign Application Priority Data

Feb. 10, 2007 (DE) ..... 10 2007 006 664

(51) Int. Cl.
*F28F 1/00* (2006.01)
*F28F 3/12* (2006.01)

(52) U.S. Cl. ..... 165/177; 165/168; 165/183

(58) Field of Classification Search ..... 165/183, 165/181, 179, 177; 29/890.039, 890.053, 29/890.054, 463

See application file for complete search history.

(56) References Cited

U.S. PATENT DOCUMENTS 1,313,387 A * 8/1919 Kaarbo ..... 220/4.06
1,946,694 A * 2/1934 Hunter ..... 138/157
2,445,268 A * 7/1948 Hodgins ..... 73/322.5
5,185,925 A * 2/1993 Ryan et al. ..... 29/890.049
5,765,634 A * 6/1998 Martins ..... 165/177
5,799,727 A * 9/1998 Liu ..... 165/170
6,192,977 B1 * 2/2001 Dey et al. ..... 165/177
6,688,382 B2 * 2/2004 Hargreaves ..... 165/177

(Continued)

FOREIGN PATENT DOCUMENTS

DE 934644 11/1955

(Continued)

OTHER PUBLICATIONS

PCT/US2007/085921 International Search Report and Written Opinion dated Apr. 30, 2008 (7 pages).

(Continued)

*Primary Examiner* — Allen J. Flanigan
*Assistant Examiner* — Jason Thompson
(74) *Attorney, Agent, or Firm* — Michael Best & Friedrich LLP

(57) ABSTRACT

Flat heat exchanger tubes having two narrow and two broad sides are shown and described, wherein the flat tubes can be manufactured from two continuous strips having a relatively large curve on one longitudinal edge of the strips and having a relatively small curve on the other longitudinal edge of the strips. The two strips can be arranged laterally transposed with respect to one another to form the wall of the flat tubes, so that the relatively large curve of the longitudinal edge of one strip holds in itself the relatively small curve of the longitudinal edge of the other strip to form the narrow sides of the flat tubes. The strips can be formed with at least one further contoured portion which extends in the longitudinal direction of the flat tubes and which improves cohesion of the flat tube.

18 Claims, 6 Drawing Sheets

U.S. PATENT DOCUMENTS

| | | | | |
|---|---|---|---|---|
| 8,091,621 | B2 * | 1/2012 | Zobel et al. | 165/177 |
| 2005/0092476 | A1 * | 5/2005 | Hu et al. | 165/177 |
| 2006/0180299 | A1 * | 8/2006 | Igami | 165/177 |

FOREIGN PATENT DOCUMENTS

| | | | |
|---|---|---|---|
| DE | 1061805 | | 7/1959 |
| DE | 10137334 | | 2/2003 |
| DE | 102006016711 | | 10/2007 |
| GB | 638161 | | 5/1950 |
| GB | 683161 | * | 7/1951 |
| GB | 683161 | | 11/1952 |
| JP | 11351777 | | 12/1999 |

OTHER PUBLICATIONS

First Office Action from the State Intellectual Property Office of China for Application No. CN 200780051159.4 dated Mar. 24, 2010 (English Translation—3 pages).

German Patent and Trademark Office Search Report Application No. 102007006664.5, dated Oct. 26, 2007 (English Translation and Original—11 pages).

* cited by examiner

HEAT EXCHANGER TUBE AND METHOD OF FORMING THE SAME

CROSS-REFERENCE TO RELATED APPLICATIONS

This is a continuation application of and claims priority to PCT Patent Application No. PCT/US07/085921 filed on Nov. 29, 2007. Priority is also hereby claimed to German Patent Application No. DE 10 2007 006664.5 filed Feb. 10, 2007. The entire contents of both prior-filed patent applications are incorporated herein by reference.

FIELD OF THE INVENTION

The present invention relates to a flat tube for heat exchangers, such as, for example, charge air coolers for motor vehicles. The heat exchanger tubes can have two narrow sides and two broad sides and can be manufactured from two contoured, continuous strips having a relatively large curve on one longitudinal edge of each strip and having a relatively small curve on the other longitudinal edge of each strip. The two strips can be arranged with respect to one another to form the walls of the flat tube, in such a way that the relatively large curve of the longitudinal edge of one strip holds in itself the relatively small curve of the longitudinal edge of another strip (and vice versa) in order to form the narrow sides of the flat tube.

BACKGROUND

Flat tubes are known from a number of older applications. One of the applications is German Patent App. No. DE 10 2006 006 670.7. FIG. 1 of German Patent App. No. DE 10 2006 006 670.7 shows a flat tube in cross section. This flat tube has a corrugated inner part z in addition to the features enumerated above. The flat tube is defined by an extremely thin wall thickness, for example in the range from 0.03 mm-0.15 mm or slightly above. Such flat tubes have already been manufactured by the applicant and installed on a trial basis in heat exchangers. Until now, such heat exchangers have successfully passed all the validation phases so that they are expected to be made commercially available soon.

In some flat tubes, undesired changes in shape of the not yet brazed flat tubes occurs within the course of manufacture. The flat tubes are brazed later, after they have been premounted in the heat exchanger core using fins. The changes in flat tube shape are possibly due to stresses present in the material (e.g., aluminum or steel in sheet form), or are generated by the necessary shaping of the strips. The changes in shape can lead to unsatisfactory braze connections, but they can also, for example, impede the joining to the corrugated inner part z (see FIG. 1). FIGS. 2*a* and 2*b* of the present application are intended to clarify the problem referred to here. One of the narrow sides of the flat tube is illustrated in the left of FIG. 2*a*. From the two illustrations on the right hand side of FIG. 2*a*, it is apparent that the curves in the narrow sides of the flat tube can spring apart from one another as a result of the effect of the shaping force during manufacture of the flat tubes. As a result, and as stated above, the brazing quality in the subsequent brazing process suffers. The arrows in FIG. 2*a* are intended to illustrate the forces which can lead to the aforementioned springing apart, and which act on the flat tube in the course of its processing to form the heat exchanger. One of the narrow sides of the flat tube is also illustrated in FIG. 2*b*. From the illustration on the right hand side of FIG. 2*b* it is apparent that, as a result of unequal application of force during the shaping process of the flat tubes, the relatively large curve does not remain in its provided position as a result of internal stresses.

In the already mentioned FIG. 1, it is also apparent that the strips or the wall parts of the flat tube can be displaced in the directions of the arrows shown there, which ultimately could cause the strips to fall apart if the above-mentioned inner part z were not present.

SUMMARY

One independent object of the present invention is to eliminate or alleviate the above-described disadvantages.

According to one aspect, there is provision for strips to be embodied with corresponding contoured portions which extend in the longitudinal direction of flat tubes and which improve cohesion of flat tubes formed from the strips by virtue of the fact that the contoured portions interact with a respective other strip. This at least largely prevents the flat tubes from springing apart or being able to be pushed apart during their processing to form a heat exchanger, that is to say before the brazing process of the heat exchanger is carried out. The preconditions for better brazing quality are thus provided.

In some embodiments, two strips are particularly preferably embodied in an identical way. Contoured portions are preferably embodied as beads, as a bend, or the like. The contoured portions are preferably arranged at the start and/or at the end of the curves.

In a case presented by way of example, there is provision for the contoured portions to be arranged approximately at the start of the large curve of one strip and to interact with the end of the small curve of the other strip. In another case also presented by way of example, there is provision for the contoured portions to be arranged approximately at the start of the large curve of one strip and to interact with a section of the small curve of the other strip. In such embodiments, the small curve can be embodied with multiple layers in an extremely favorable way, as a result of which even more stable narrow sides can be produced.

In yet another case, there is provision for the contoured portions to be arranged approximately at the start of the small curve and approximately at the end of the large curve of the two strips, in which case they interact in such a way that the contoured portions fit into one another approximately.

In an advantageous development, there is provision for the large curves and/or the small curves to be embodied in multiple layers. The multiply-layered structure can be generated by folds in the curves. In this way it is possible, as mentioned, to considerably strengthen the narrow sides of the flat tube.

The present invention will be described in a plurality of exemplary embodiments by means of the appended sketches. Other aspects of the present invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the accompanying drawings. The present invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Five exemplary embodiments have each been represented with four illustrations which have been designated by the letters a-d. The illustration a in each case shows an enlarged view of a large or small curve B, b of a contoured strip. The illustration b in each case shows one of the contoured strips. The illustration c in each case shows a narrow side 1 of a flat tube formed from a large curve B of the one strip and a small curve b of the other strip. Finally, the illustration d in each case shows the respective flat tube as a view which corresponds to a cross section through the flat tube.

Figure 1:
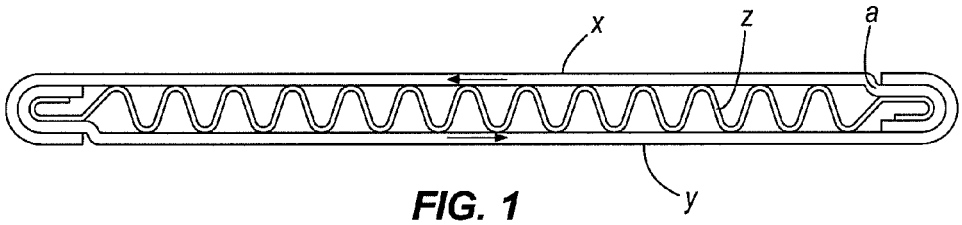
FIG. 1 PRIOR ART
FIG. 1 shows the cross section through a prior art flat tube.
Figure 2A:
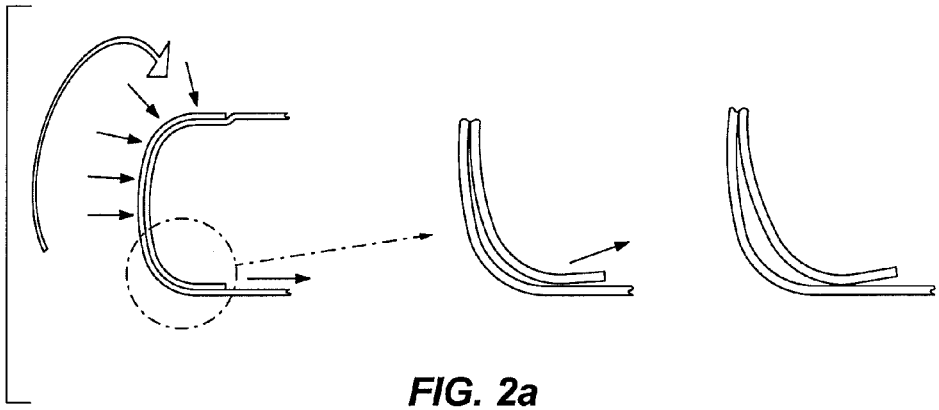
FIGS. 2*a* and 2*b* show a problem with prior art flat tubes.
Figure 2B:
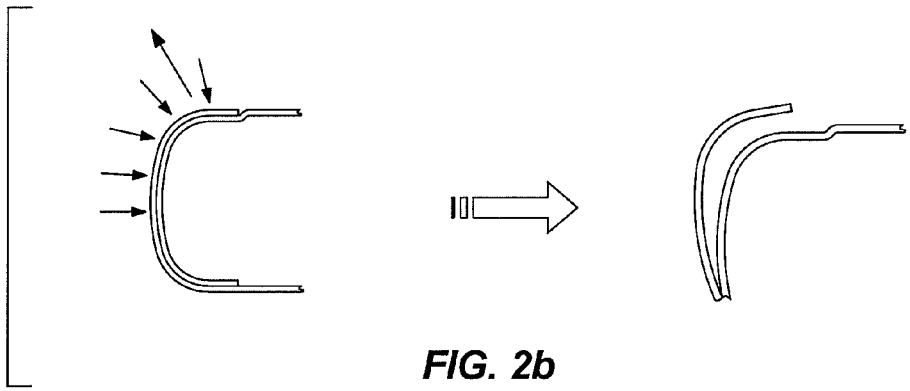
Figure 3A:
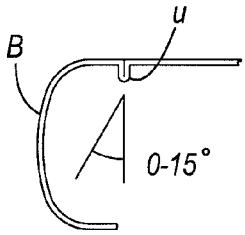
FIGS. 3*a-d* show a first exemplary embodiment for solving the problem shown in FIG. 2*a*, FIGS. 4*a-d* show a second exemplary embodiment for solving the problem shown in FIG. 2*a*, FIGS. 5*a-d* show a third exemplary embodiment for solving the problem shown in FIG. 2*a*, FIGS. 6*a-d* show a fourth exemplary embodiment for solving the problem shown in FIG. 2*b,*
Figure 3B:
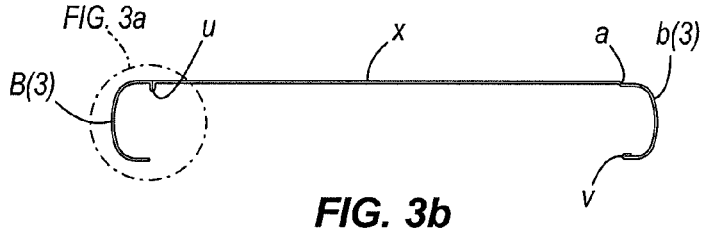
Figure 3C:
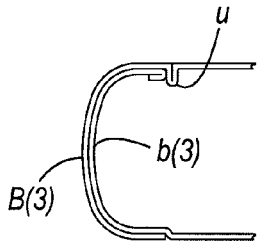
Figure 3D:
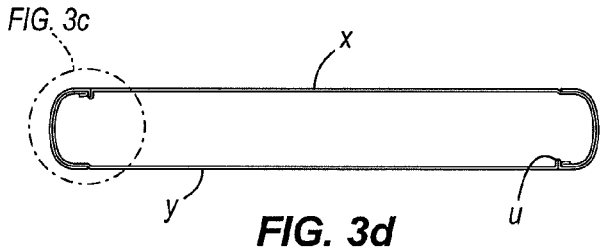
Figure 4A:
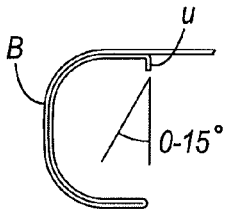
Figure 4B:
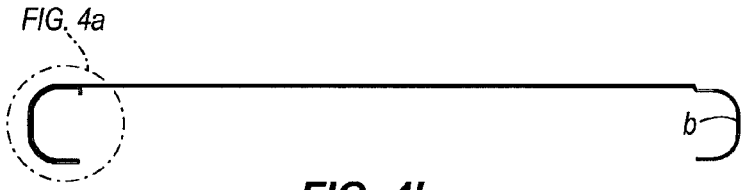
Figure 4C:
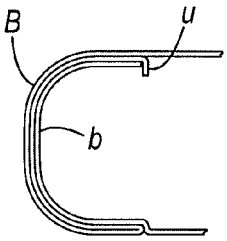
Figure 4D:
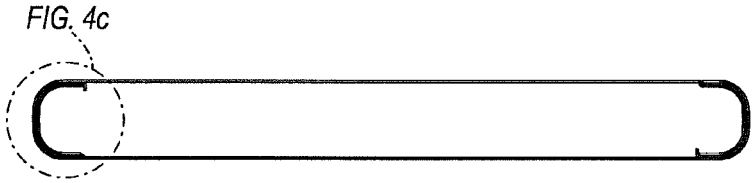
Figure 5B:
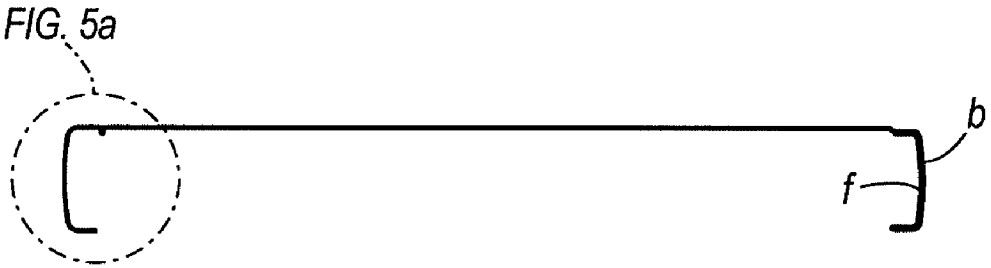
Figure 5D:
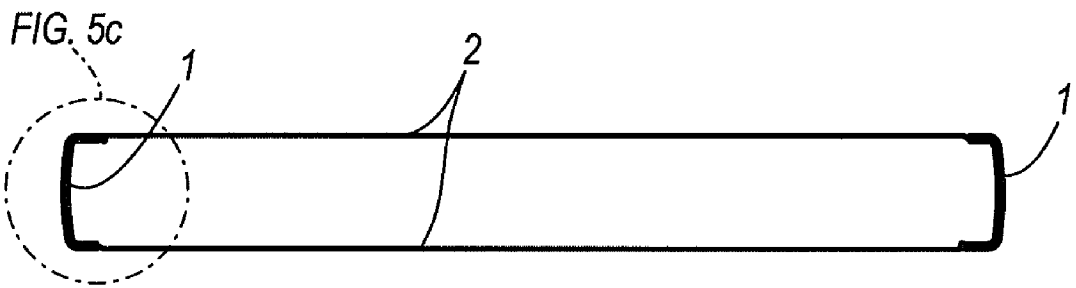
Figure 5A:
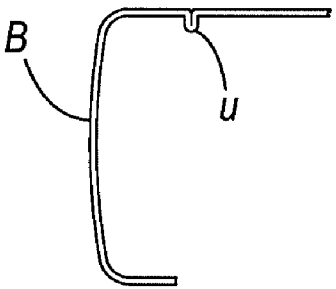
Figure 5C:
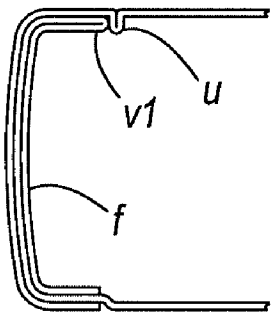
Figure 6A:
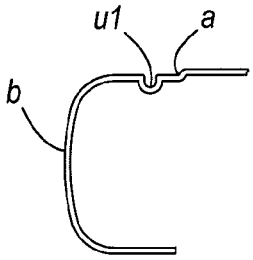
Figure 6B:
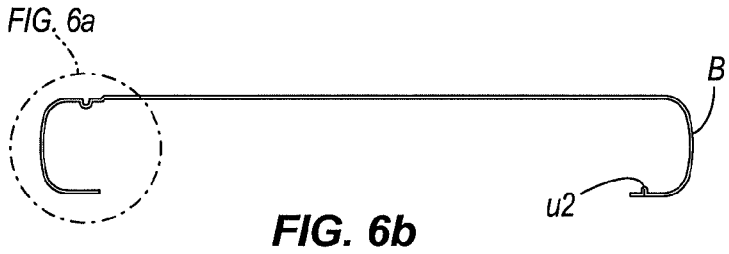
Figure 6C:
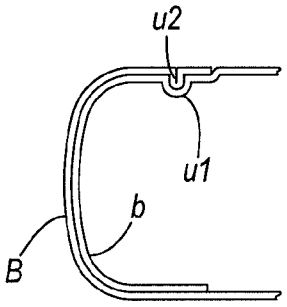
Figure 6D:
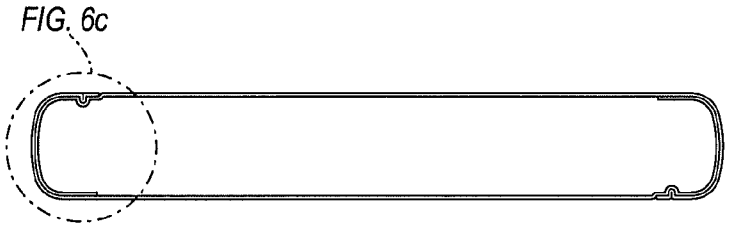
Figure 7A:
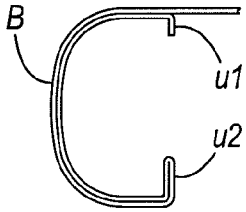
FIGS. 7*a-d* show a fifth exemplary embodiment for solving the problems shown in FIGS. 2*a* and 2*b,*
Figure 7B:
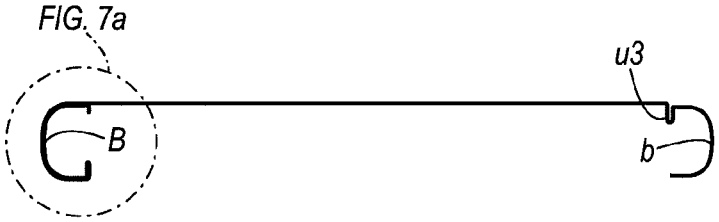
Figure 7C:
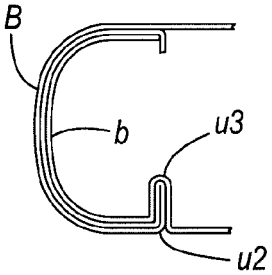
Figure 7D:
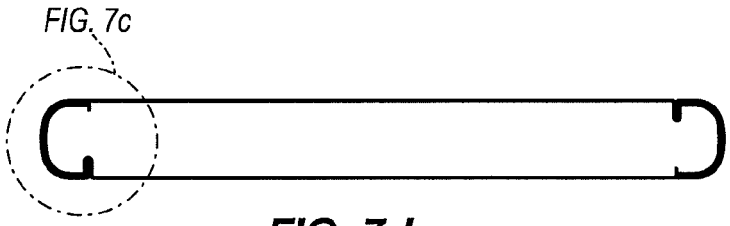

In all the exemplary embodiments shown, an inner part z may be present, such an inner part z shown in FIG. 1 (for example). In all the exemplary embodiments herein, a step a, which is compensated by applying the large curve B, is located approximately at the start of each small curve b. The term "curve" should not be understood herein in a restrictive fashion as a circular or parabola-like curve. As used herein, the term "curve" should also be understood to be a transition on a flat tube (having straight narrow sides 1) from one broad side 2 of the tube to the other.

In each of the illustrated exemplary embodiments, the two strips x and y are substantially identical, and are arranged in a laterally transposed fashion with respect to one another in order to form a flat tube. In addition, the thicknesses of the strips can be approximately in the range from about 0.03 mm to about or slightly above 0.15 mm. In addition, the strip thickness for an inner part (e.g., z), if one is provided, can be in the range from about 0.03 mm to about 0.09 mm. In addition, the flat tubes can be flat tubes for charge air coolers which are used in motor vehicles. All other heat exchanger applications and fields of use are not excluded. The large or relatively large curve B is referred to herein as such because it is suitable for holding in itself (i.e., in nested relationship) the other curve which has been referred to as the small or relatively small curve b. In fact, in view of the extremely thin sheet metal thicknesses that can be used for the strips, there may be no size differences between the curves B, b which can be perceived at first sight.

The first exemplary embodiment according to FIG. 3 shows as a contoured portion u a bead which is folded onto itself and which is located approximately at the start of the large curves B of the two strips x, y, and which extends the entire length of the flat tube. As is clarified by FIG. 3*c*, the end of the small curve b of the other strip y bears against this bead, as a result of which the bead interacts with the other strip y. The end of the small curve b has been provided in this exemplary embodiment with a turnover v of the edge of the ribbon-shaped material in order to improve the interaction of the end of the small curve b with the bead u during the manufacturing process and rabbeting of the flat tube. The cohesion of the two strips of the flat tube is thus improved.

In the exemplary embodiment according to FIG. 4, flat tubes whose narrow sides 1 are embodied with three layers are provided. In this embodiment, a simple bend is provided as a contoured portion u which is located at the end of the large curves B. The large curves B have a simple fold. In each case, the end of the small curve b of the other strip bears against the aforesaid bend u, as a result of which the bend u interacts with the other strip. Here too, the strip with the relatively small curve b can be provided at the end with a turnover v of the edge of the ribbon-shaped material in a manner similar to the exemplary embodiment of FIGS. 3*a*-3*d* (not illustrated in FIG. 4).

In the exemplary embodiment according to FIG. 5, narrow sides 1 of the flat tube are provided with three layers. As in the first exemplary embodiment, a bead as a contoured portion u is arranged at the start of the relatively large curve B. However, in contrast to the embodiments described above, the relatively small curve b of the other strip is provided with a fold f which results in doubling of the thickness of the strip at the narrow side, wherein a section v1 of the doubled small curve b bears against the aforementioned bead u, as a result of which the bead interacts with the other strip. Because, as a result of the fold f of the other strip, the end of the relatively small curve b (referred to here as v1) is embodied with a double layer, the end v1 acts in a way corresponding to the above-described turnover v of the edge of the ribbon-shaped material of the exemplary embodiments according to FIGS. 3 and 4. An additional turnover of the edge of the ribbon-shaped material can be dispensed with here.

In the exemplary embodiment according to FIG. 6, the two strips x, y of the flat tube each have two contoured portions u1 and u2. An "open" bead is provided as a contoured portion u1 approximately at the start of the small curve b, and a bead which is folded onto itself is provided approximately at the end of the large curve B as a contoured portion u2. The beads u1, u2 are matched in terms of their dimensions so that the bead u2 at the end of the large curve B of one strip fits into the open bead u1 at the start of the small curve b of the other strip, as a result of which each bead interacts with the other strip.

In the exemplary embodiment according to FIG. 7, another flat tube with three-layered narrow sides 1 is presented. The relatively large curve B has been doubled, and a bend is provided at the end of the relatively large curve B as contoured portion u1. In a section of the doubled portion, a bead which has been folded onto itself and which is referred to as contoured portion u2 is provided. Approximately at the start of the relatively small curve b, an "open" bead which is referred to as contoured portion u3 has been provided. The contoured portion u3 at the start of the relatively small curve b of one strip engages over the folded bead u2 in the doubled portion of the relatively large curve B of the other strip. In addition, the end of the relatively small curve b (just mentioned) of one strip bears against the bend u1 at the end of the relatively large curve B of the other strip, as a result of which the bend u1 interacts with the other strip.

Figure 8:
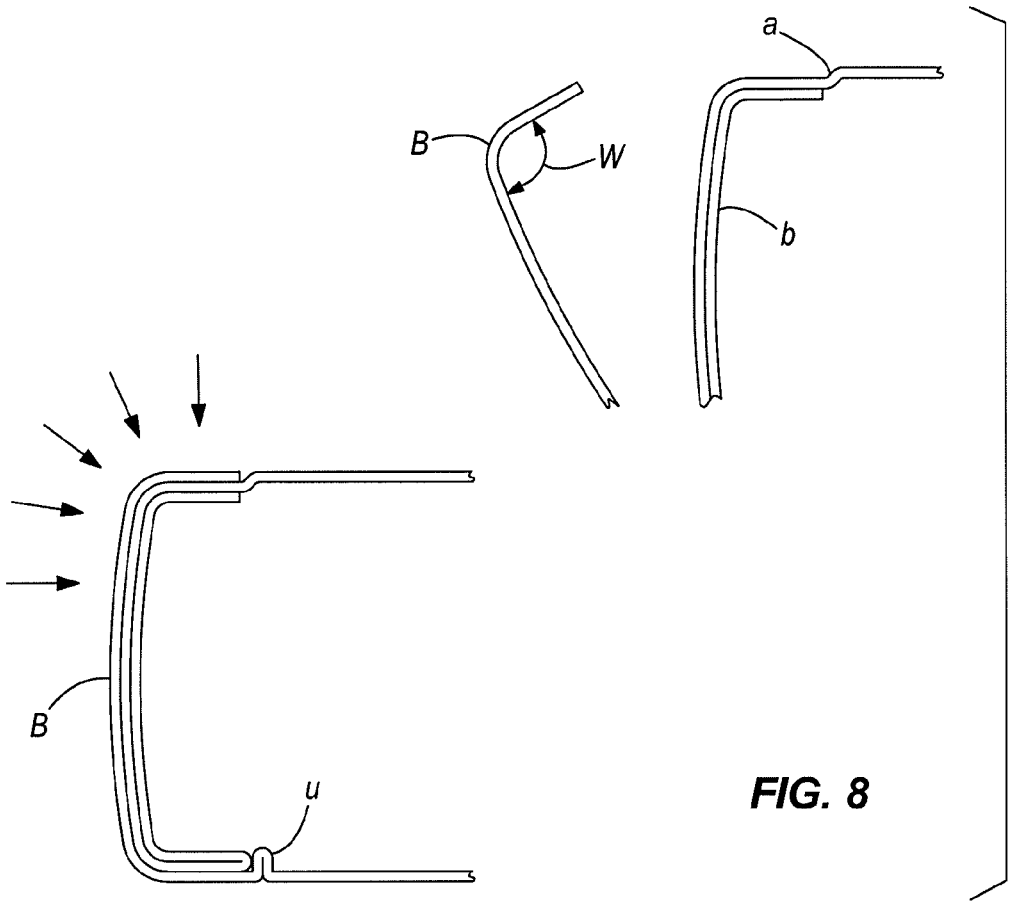
FIG. 8 shows a suitable additional measure for the exemplary embodiment of FIGS. 5*a-d*, and thus a solution of the problems shown in FIGS. 2*a* and 2*b*.

FIG. 8 shows in two illustrations a development of the exemplary embodiment according to FIGS. 5*a*-5*d*, in which the end of the relatively large curve B of one strip is provided with a slightly smaller bend angle w so that in a last step, the aforementioned end can be pushed, with a certain degree of pre-stress, onto or against the start of the relatively small curve b, having the step a, of the other strip, as a result of which dimensional stability is increased further.

Figure 9:
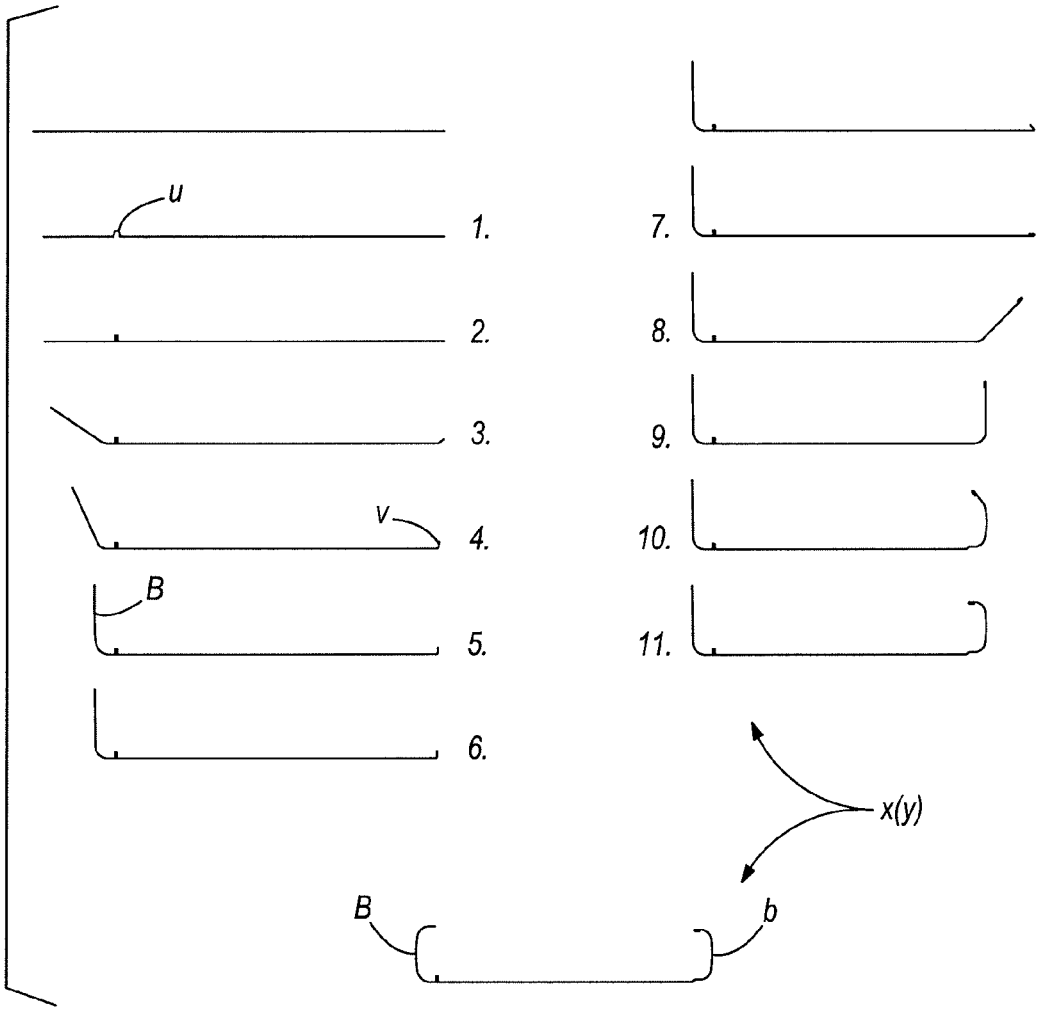
FIG. 9 shows individual steps in the course of the manufacture of a strip according to an embodiment of the present invention.

FIG. 9 shows a number of steps for manufacturing a single strip x or y according to some embodiments of the present invention. The illustrated manufacturing method for all the strips x, y and possibly z of the flat tube or for the flat tubes can be carried out on a roller train or fabrication line, which is shown and described in the above-mentioned patent applications. As can be discerned by comparison, FIG. 9 relates to the manufacture of the strips x, y which are used in the first exemplary embodiment according to FIGS. 3*a*-3*d*. The formation of the contoured portion u is begun starting from the continuous strip x or y which has not yet been shaped, after which the formation of the relatively large curve B is started. This is followed by the steps shown in the left-hand column of FIG. 9, which are continued in the right-hand column at the top of FIG. 9. The illustration at the bottom of FIG. 9 shows a strip x or y which has been completed. In some embodiments, two identical strips x and y are combined approximately in the state according to the eleventh step, in the right-hand column at the bottom of FIG. 9. In such embodiments, each strip x or y is positioned in a laterally transposed fashion to form the flat tube, the other strip y or x (not shown there) being placed from above, with its relatively small curve b into the relatively large curve B (not yet completed) of the illustrated strip x or y, wherein the relatively large curve B of the strip which is not illustrated engages around the relatively small curve b of the illustrated strip from above.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A flat tube for heat exchangers, the flat tube comprising:

first and second narrow sides and first and second broad sides manufactured from two continuous strips of material, each strip having a relatively large curve on one longitudinal edge of the strip, and having a relatively small curve on another longitudinal edge of the strip;

wherein the two strips are arranged with respect to one another in order to form a wall of the flat tube in such a way that the relatively large curve of a longitudinal edge of one strip holds in itself the relatively small curve of a longitudinal edge of the other strip in order to form each of the first and second narrow sides of the flat tube;

wherein the large curve has a start and an end and the small curve has a start and an end; and wherein each of the two strips includes a first contoured portion extending into an interior of the tube, and a second contoured portion formed along an exterior of the flat tube, the first contoured portion of one of the strips engaging the end of the small curve of an other of the strips and a second contoured portion of the one of the strips engaging the end of the large curve of the other of the strips.

2. The flat tube according to claim 1, wherein the first contoured portion is a bead and the second contoured portion is a bend in the corresponding strip of material.

3. The flat tube according to claim 1, wherein the first and second contoured portions are arranged at one of a start and an end of the curves.

4. The flat tube according to claim 1, wherein the first contoured portions are arranged approximately at a start of the large curve of each strip and interact with an end of the small curve of the other strip.

5. The flat tube according to claim 4, wherein the end of the small curve includes a turnover of the edge of the strip.

6. The flat tube according to claim 1, wherein the first contoured portions are arranged approximately at a start of the large curve of each strip and interact with a section of the small curve of the other strip.

7. The flat tube according to claim 1, wherein the first and second contoured portions are arranged approximately at a start of the small curve of each strip and approximately at an end of the large curve of each strip, wherein the first and second contoured portions fit into one another.

8. The flat tube according to claim 7, wherein the first and second contoured portions are beads, one bead being embodied as an open bead into whose opening another bead fits.

9. The flat tube according to claim 1, wherein at least one of the large curve and the small curve is embodied in multiple layers formed at least in part by a fold.

10. The flat tube according to claim 5, wherein the turnover abuts the first contoured portion.

11. The flat tube according to claim 1, wherein the first contoured portions are arranged at a start of the large curve of each strip and wherein the second contoured portions are arranged at a start of the small curve of each strip.

12. The flat tube according to claim 1, wherein the small curve contacts the large curve along substantially an entire portion of the narrow sides.

13. The flat tube according to claim 1, wherein the small curve contacts the large curve along substantially an entire length of the small curve and the large curve between the starts and ends of the small curve and the large curve.

14. The flat tube according to claim 1, wherein the end of the large curve abuts the second contoured portion, and wherein the end of the small curve abuts the first contoured portion.

15. The flat tube according to claim 1, wherein the large curve curves along about 180 degrees, wherein the second curve curves along about 180 degrees.

16. The flat tube according to claim 15, wherein the large curve contacts the small curve along the entire curve of about 180 degrees.

17. The flat tube according to claim 1, wherein the first contoured portion is a fold in the strip adjacent the start of large curve.

18. The flat tube according to claim 1, wherein the large curve defines a large radius, wherein the small curve defines a small radius, and wherein the small radius nests within the large radius along the entire small curve and the entire large curve.

* * * * *